United States Patent [19]

Hybertson

[11] Patent Number: 4,921,372

[45] Date of Patent: May 1, 1990

[54] SIDEWALK SCRIBING TOOL

[76] Inventor: Delmer L. Hybertson, P.O. Box 127, Centerville, S. Dak. 57014

[21] Appl. No.: 432,382

[22] Filed: Nov. 6, 1989

[51] Int. Cl.[5] ..... E01C 23/09

[52] U.S. Cl. ..... 404/89; 249/1; 249/2; 249/52; 249/207; 249/214; 249/217; 404/97; 425/458; 425/470

[58] Field of Search ..... 52/364, 365, 367, 371; 404/96, 97, 89, 118, 119, 120, 133; 249/1, 2, 52, 207, 214, 217; 264/31, 33, 333; 425/458, 470

[56] References Cited

U.S. PATENT DOCUMENTS

| | | | |
|---|---|---|---|
| 2,949,068 | 8/1960 | Gresham | 404/89 |
| 3,194,130 | 7/1965 | Guntert | 404/89 |
| 4,822,209 | 4/1989 | Dragich | 404/89 |

*Primary Examiner*—Jerome W. Massie, IV
*Assistant Examiner*—Roger J. Schoeppel

[57] ABSTRACT

A tool for scribing lines in soft concrete in which the line can be impressed by a standing operator. Guides are provided on the tool to assure a proper angle of the scribed line. A grooving tool can then follow the scribed line without added guide because the line will be located and all rough aggregate in the concrete will have been moved out of the path of the grooving tool.

7 Claims, 1 Drawing Sheet

SIDEWALK SCRIBING TOOL

BACKGROUND AND SUMMARY OF THE INVENTION

This invention pertains to devices for scribing lines in soft concrete which has been poured for sidewalks or the like. The device is designed for use by a workman who is standing alongside the sidewalks, and provides a guide line for the later use of a grooving tool.

Most concrete sidewalks are marked with lines separating the surface of the walks into blocks or squares. These lines are customarily formed by use of a grooving tool moved by hand across the surface of the concrete before it sets. To guide it in a line perpendicular to the edge, the grooving tool is ordinarily run alongside a board laid across the forms for the edge of the sidewalk. This requires adjustment of the guide board perpendicular to the edge of the walk. It also requires that the grooving tool make the full groove. Thus the grooving tool must push aside or down, all stones or any other irregularity in the concrete. On occasion, the result may be a deviation from a straight line.

By my invention I provide a tool which is easy for a worker to use while in a standing position. The tool provides for indenting the unset concrete with a line perpendicular to the forms at the edge of the sidewalk, and therefore avoids any unnecessary work in squaring the guide board. The tool also forms an initial groove which can be easily followed by the grooving tool. Furthermore, the indentation formed by my tool pushes aside or pushes down any stones or larger aggregate so that the grooving tool does not wander from its proper path. I do this by providing a blade adapted to impress the lines having handles for use by the worker. A guide engageable with the sidewalk forms is attached to the blade to assure the perpendicular alignment of the grooved line.

DESCRIPTION

Briefly my invention comprises a tool for indenting unset concrete poured as a sidewalk. The tool is adapted for use by a worker standing alongside the poured sidewalk and will provide an initial groove easily followed by a grooving tool.

Figure 1:
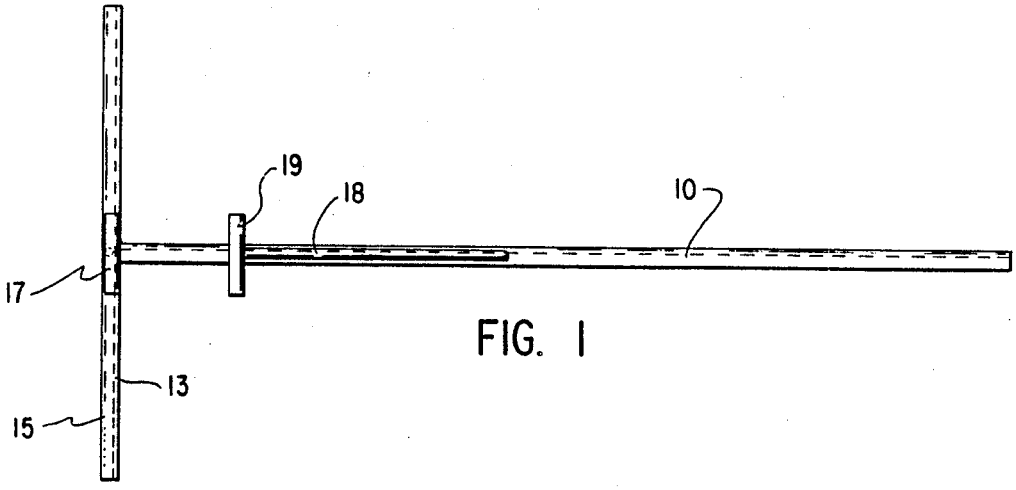
FIG. 1 is a top plan view of my tool.
Figure 2:
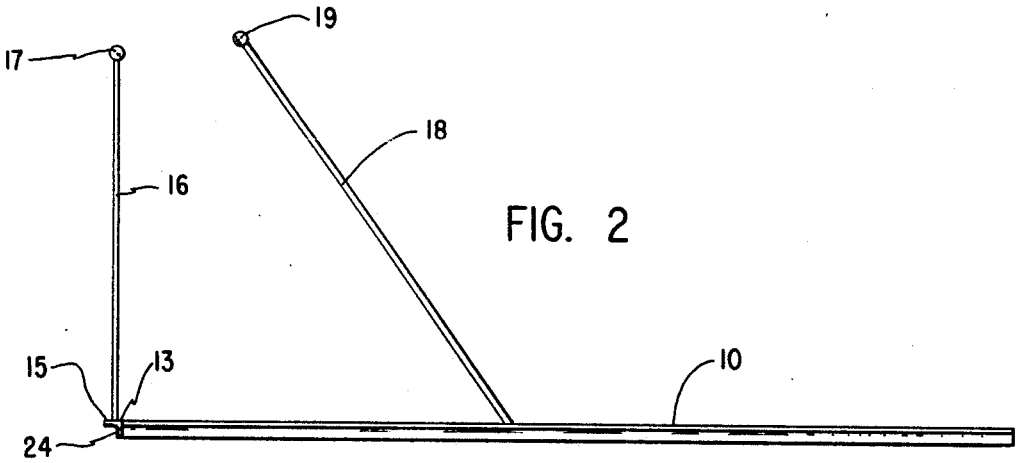
FIG. 2 is a side elevational view of the tool.
Figure 3:
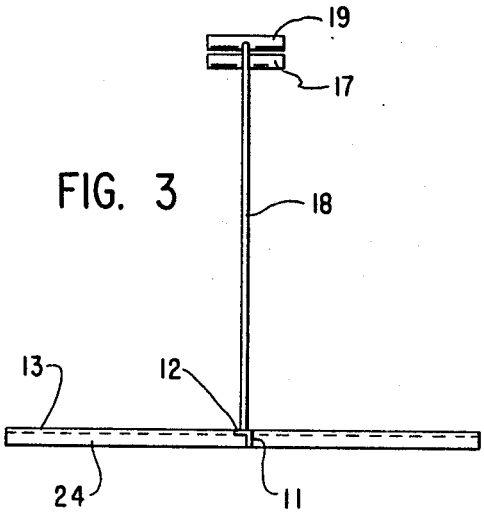
FIG. 3 is an end elevational view of the tool of FIG. 2.
Figure 4:
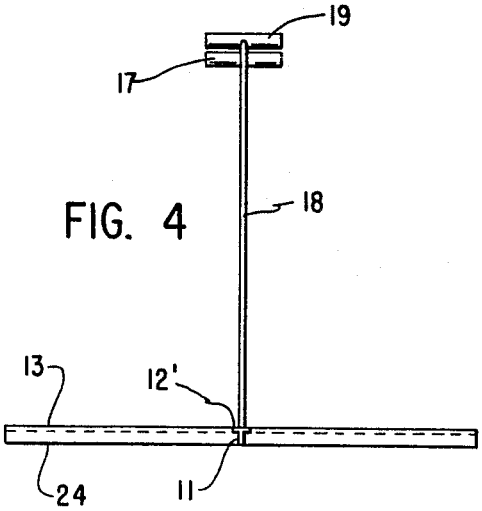
FIG. 4 is a view similar to FIG. 3 of the tool with a slightly different blade.

More specifically and referring to the drawings, the new tool comprises a blade 10 having a vertical tongue 11 which can be pressed into unset concrete. The tongue is stiffened by a horizontal web 12 to form a right angle shape in the embodiment of FIG. 3 or a web 12' to form a "T" shape in the embodiment of FIG. 4. The principal reason for preference between these two embodiments is that the "T" shape is somewhat stiffer than the angle particularly against twisting. The principal objection to the "T" shape might be slightly less accuracy in locating the scribed lines. In both cases, the principal reason for the web is to stiffen the tongue 11 and to prevent bending or misalignment of that tongue.

A guide member 13 is affixed to the blade 10 at a right angle. The guide member is adapted to be aligned with the form at the edge of the sidewalk. I prefer to provide this alignment simply by the use of an angle-shaped bar having a vertical part 24 adapted to lie alongside the form and a horizontal part 15 which will engage the top of the form to provide that the tool not be impressed too deeply into the concrete.

A nearly vertical bar 16 extending from the guide member 13 supports a first T-handle 17. A slanting bar 18 supports a second T-handle 19 from the blade 10. The two handles 17 and 19 are placed close enough together and close enough to the vertical from the guide member 13 that a single operator standing near the member 13 can, by using both hands, guide and place the tool where it is supposed to be and then impress the tongue 11 into the newly troweled concrete.

The operation of the device should be apparent from its description. After the concrete is poured into the sidewalk forms and the surface trowelled as desired, the tool guide member 13 is placed on the form at the desired location. It may be moved slightly along the form, if the location of the line to be impressed is not exactly where the tool is first placed. This is accomplished by a single operator using two hands on the two handles 17 and 19. When the tool is properly located, it is simply pressed into the soft concrete so that the tongue 11 makes the proper indentation in the material. Again a single operator can accomplish this simply by pressing on the handle 19. The tool can then be taken up and moved to the next location. The indentation left by the present tool then provides a groove through which the grooving tool may easily be moved to provide the desired marking in the concrete without any need for additional guides and without concern for being diverted by larger aggregate in the material of the walk.

It is conceived that the length of the blade 10 could be made adjustable either by a simple addition of sections or by using a telescoping blade. I prefer in the former so that there will not be a noticeable difference in the width of the groove left in the concrete.

I claim as my invention:

1. A tool for striking lines in a newly poured concrete sidewalk comprising blade means having a vertical portion adapted to be pressed into said concrete, guide means perpendicularly attached to and extending in the same plane of said blade means whereby said guide means will locate the position of said blade means, and handles extending upwardly from said blade means and said guide means whereby said tool may be manually placed in relation to said sidewalk.

2. The tool of claim 1 in which said blade means includes a vertical tongue adapted to be impressed into said concrete and a horizontal web on said tongue adapted to stiffen said tongue in a lateral direction.

3. The tool of claim 2 in which said tongue and web form a right-angle shape in cross section.

4. The tool of claim 2 in which said tongue and web form a T-shape in cross section.

5. The tool of claim 2 in which said guide means is a bar having a cross section of right angle shape fixed to said blade means to form a T-shape in plan form.

6. The tool of claim 2 in which a bar extends vertically from said guide means and a second bar extends slantingly upward from a point on said blade means substantially spaced from said guide means to a position adjacent the upper end of said first named bar, and handle means affixed to both bars at their upper ends.

7. The tool of claim 6 in which said handles comprise cross members forming T-shaped handles on said bars.

* * * * *